United States Patent [19]

Nemiroff

[11] 4,352,862

[45] Oct. 5, 1982

[54] THERMALLY STABLE MAGNETIC FILM WHICH RESISTS HARD BUBBLES

[75] Inventor: Michael H. Nemiroff, Del Mar, Calif.

[73] Assignee: Burroughs Corporation, Detroit, Mich.

[21] Appl. No.: 205,100

[22] Filed: Nov. 10, 1980

[51] Int. Cl.[3] ..... H01F 1/00; B05D 3/06

[52] U.S. Cl. ..... 428/694; 427/53.1; 427/82; 427/130; 428/336; 428/611; 428/900

[58] Field of Search ..... 427/53.1, 130, 82; 365/3, 1, 31, 32, 33, 161; 252/62, 57; 428/900, 694, 611, 336

[56] References Cited

U.S. PATENT DOCUMENTS 3,991,233 11/1976 Verhulst et al. ..... 427/130

4,042,341 8/1977 Smeggil ..... 427/130 X 4,104,422 8/1978 Sandfort ..... 427/123

4,171,389 10/1979 Gyorgy et al. ..... 427/130

4,214,918 7/1980 Gat et al. ..... 427/53.1 X

*Primary Examiner*—Thurman K. Page

*Attorney, Agent, or Firm*—Charles J. Fassbender; Kevin R. Peterson; J. Ronald Richbourg

[57] ABSTRACT

Disclosed is a crystalline magnetic film having at least two rare-earth elements symmetrically disposed at lattice sites in the film's interior to there produce a magnetic moment perpendicular to the film's surface; and having those same rare-earth elements less symmetrically disposed at lattice sites in a region at the film's surface, to there produce a magnetic moment parallel to the surface. This in-plane magnetic moment resists hard bubbles from forming in the film; and it is stable at temperatures over 500° C.

13 Claims, 5 Drawing Figures

THERMALLY STABLE MAGNETIC FILM WHICH RESISTS HARD BUBBLES

BACKGROUND OF THE INVENTION

This invention relates to magnetic bubble memory devices; and more particularly it relates to the fabrication of magnetic films which resist "hard bubbles" from forming in them.

One exemplary magnetic bubble memory device of the prior art, in which a magnetic film constructed according to the invention could advantageously be incorporated, is illustrated in FIG. 1. That bubble memory includes a $G^3$ substrate 10 having a magnetic film 11 lying on one surface 10*a* of the substrate. Suitably, substrate 10 and film 11 respectively are 500 μm thick and 2.0 μm thick.

Film 11 is comprised of a crystalline iron garnet material; and the crystal has a growth induced magnetic anisotropy which produces magnetic moments throughout the film in a direction perpendicular to its surface. In operation, a bias magnetic field 12 is applied in one direction perpendicular to the film's surface. Then, each region in film 11 where a growth induced magnetic moment exists in a direction opposite to bias field 12 constitutes one magnetic bubble. Reference numeral 13 indicates one such bubble in film 11, while reference numeral 14 indicates non-bubble regions in film 11.

Also included in the prior art bubble memory device of FIG. 1 is an insulating layer 15, a current carrying conductor 16, another insulating layer 17, and bubble propagating elements 18. Suitably, layer 15 is 4500 A° thick silicon dioxide; conductor 16 is 3500 A° thick aluminum with 2% copper; layer 17 is 1500 A° thick silicon dioxide; and propagating elements 18 are 3500 A° thick nickel-iron alloys. Propagating elements 18 are patterned to define "paths" for the bubbles to follow in response to an in-plane rotating magnetic field (that is, a magnetic field which rotates in a plane parallel to the surface of film 11); and conductors 17 are patterned to define various "gates" which direct the bubbles to follow one path or another depending on the presence or absence of current in the conductor.

However, in order for magnetic bubbles in film 11 to propagate in a predictable manner along the paths defined by elements 18 and to be steered in a reliable fashion by the current in conductors 17, they must be "soft" bubbles, not "hard" bubbles. Soft bubbles are those which have no or only a few number of moment reversals around their domain wall (e.g., —two or less); whereas hard bubbles have a large number of moment reversals. One hard bubble is indicated in FIG. 1 by reference numeral 19, wherein the domain wall 20 has six moment reversals. Each location in the domain wall where a moment reversal occurs is known as a "vertical block line" 21.

One problem with hard bubbles is that they move at an unpredictable angle with respect to the rotating in-plane magnetic field. That angle varies with the number of vertical block lines in the domain wall, which is not controllable in hard bubbles. Another problem with hard bubbles is that they are less mobile than soft bubbles. Also, hard bubbles require a higher external magnetic field than do soft bubbles to cause their collapse. Thus, since hard bubbles cannot be accurately positioned, cannot be propagated at high frequencies, and are difficult to annihilate, it is highly desirable to construct film 11 such that it resists hard bubbles from forming in it.

In the past, this was achieved by constructing film 11 with materials having a negative magnetostriction coefficient; and by implanting the surface region of that film with neon atoms. These implanted atoms mechanically stressed and distorted the crystalline lattice in the surface region. Thus, due to this stress and the negative magnetostriction coefficient, a magnetic moment was induced in the surface region parallel to the film's surface. And a magnetic moment in that direction in the surface region resists hard bubbles from forming in the film.

Further, in addition to suppressing hard bubbles, it has been reported in the prior art that bubbles adhere to the boundary of an implanted magnetic moment at the film's surface. See for example, "Applications of Ion Implantation to Magnetic Bubble Devices," *Journal of Vacuum Society Technology,* Vol. 15, No. 5, Sept./Oct. 1978, pps. 1675–1684. Thus, by patterning the implant region, bubble "guide rails" can be formed right inside of film 11, which eliminate the need for the propagating elements 18.

But a problem with implanted magnetostrictively induced magnetic moments is that they are not thermally stable. Thus, even at relatively low processing temperatures (such as 300° C., for example) the implanted atoms "gas out" of the film's surface. Then the film's crystal reverts back towards its undistorted and unstressed form; and in doing so, the magnetic moment lying parallel to the surface is almost completely dissipated.

This problem is severe because temperatures of 400° C. in the implanted region may easily be exceeded by many conventional processing techniques which could be used to form the various structures that overlie the film in a bubble memory (i.e. —the oxide layers 15 and 17). Therefore, those techniques are rendered useless if the film has previously been implanted to provide a magnetic moment parallel to the film's surface.

Accordingly, the primary objects of this invention are to provide a thermally stable magnetic film, and method of fabricating the same, which resists hard bubbles from forming in it.

BRIEF SUMMARY OF THE INVENTION

These and other objects are accomplished in accordance with the invention by a crystalline magnetic film having at least two rare-earth elements symmetrically disposed at lattice sites in the film's interior to there produce a magnetic moment perpendicular to the film's surface; while in the film's surface region, the rare-earth elements are less symmetrically disposed at the lattice sites to there produce a magnetic moment parallel to the surface. That is, in the surface region, the crystal is undistorted and unstressed just as it is in the interior and it is only the asymmetry with which the rare-earth elements are disposed at the crystalline lattice sites which gives rise to the in-plane magnetic moment. Accordingly, the thermal stability of this film is substantially greater than the thermal stability of films having implanted magnetostrictively induced magnetic moments, because there are no implanted atoms to "gas out". Further, the film of the present invention need not be restricted to a negative magnetostrictive material, because the in-plane magnetic moment in the surface region is not produced by a distortion or stressing mechanism.

Preferably, the magnetic film of this invention is fabricated by the steps of providing a crystalline film of magnetic material having at least two rare-earth elements symmetrically disposed throughout the film's crystalline lattice; and supplying energy to the surface region of the film to there produce interstitial diffusion of the rare-earth elements among the lattice sites. This energy supplying step preferably is performed via a laser anneal in which the laser beam wavelength is selected to confine the energy absorbed from the beam to the film's surface, and in which the laser scans the film's surface at a rate which minimizes energy transfer from the surface region to the bulk region via thermal conduction.

DESCRIPTION OF THE DRAWINGS

Various features and advantages of the invention will best be understood by reference to the following detailed description and accompanying drawings wherein.

DETAILED DESCRIPTION OF THE INVENTION

Figure 2:
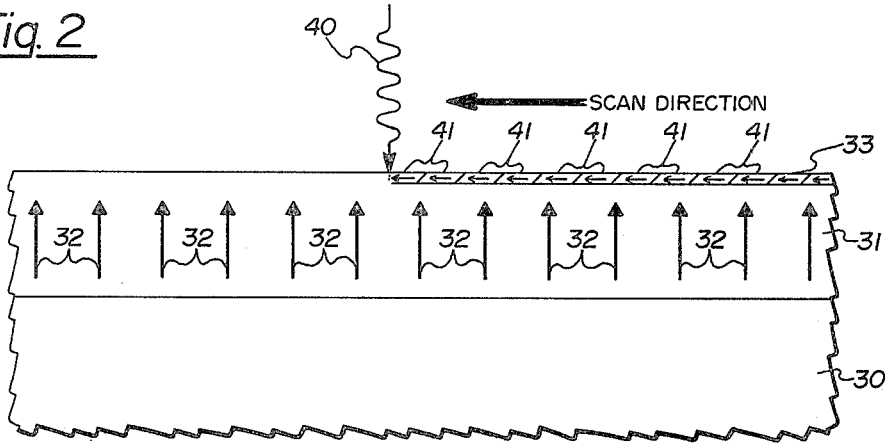
FIG. 2 is a greatly enlarged cross-sectional view illustrating the fabrication process of the present invention.

Referring now to FIG. 2, a bubble memory device and process for fabricating the same according to the invention will be described in detail. The process begins by providing a $G^3$ substrate 30 having a crystalline iron-garnet film 31 grown on it. At least two rare-earth elements are symmetrically disposed throughout the film's crystalline lattice to produce a magnetic moment 32 perpendicular to the film's surface. Suitably, film 31 is a calcium-germanium-iron garnet of the form $(M, Re_1, Re_2, Re_3, Ca)_3 (Fe, Ge)_5 O_{12}$; or a gallium-iron garnet of the form $(M, Re_1, Re_2, Re_3)_3 (Fe, Ga)_5 O_{12}$; or an aluminum-iron garnet of the form $(M, Re_1, Re_2, Re_3)_3 (Fe, Al)_5 O_{12}$. In these formulas, $Re_1$, $Re_2$, and $Re_3$ denote rare-earth elements, and M denotes the elements Y and Sc.

Thereafter, the surface region 33 of film 31, but not the bulk portion of film 31, is rapidly and locally annealed by means of a laser beam 40. Preferably, the depth of region 33 is less than 0.60 mm. By this laser anneal step, energy is transferred from the laser beam to the atoms in surface region 33; and this energy transfer causes a portion of the atoms in the surface region to redistribute themselves about the crystalline lattice. Thus, the symmetry with which the rare-earth elements are disposed in that region is reduced in comparison to their symmetrical disposition in the film's bulk; and this gives rise to a magnetic moment 41 in surface region 33 which lies parallel to the surface. Magnetic moment 41 in turn, makes film 31 resistive to hard bubble formation.

As one specific example of the above annealing step, an argon laser having a beam wavelength of 458 nanometers can be used to heat surface region 33 to 1200° C.–1700° C. At those temperatures, the above-described redistribution of rare-earth elements will occur. Also at that wavelength, film 31 is highly absorptive of the laser beam energy; and so a relatively large portion of the beam energy is absorbed in the surface region. This is important because it maximizes the redistribution of rare-earth elements in surface region 33, while at the same time minimizes their redistribution in the film's bulk. Preferably, the laser beam's wavelength is less than 5000 A°; because as beam wavelength is shortened, that percentage of the beam's total energy which is absorbed at the film's surface rapidly increases.

Also preferably, laser beam 40 is moved rapidly from point to point over surface region 33 in order to minimize the transfer of energy from the surface region to the film's bulk through thermal conduction. One specific way to meet this constraint is to let no point on surface 33 continuously receive energy from the laser for more than 50 milliseconds. Thus, a laser beam of 100 μm diameter scanning at 10 cm/sec would continuously expose a point on surface 33 for only 1 ms, which would be acceptable.

Figure 3A:
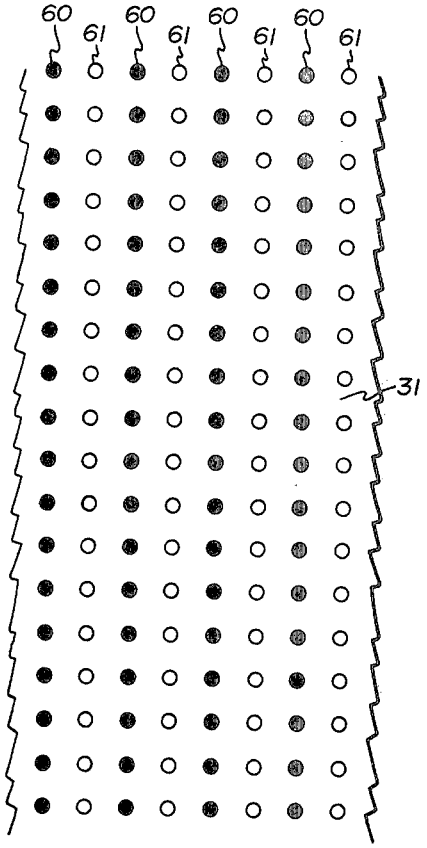
FIGS. 3A and 3B are schematic diagrams illustrating, on an atomic scale, the structure produced by the process of FIG. 2.
Figure 3B:
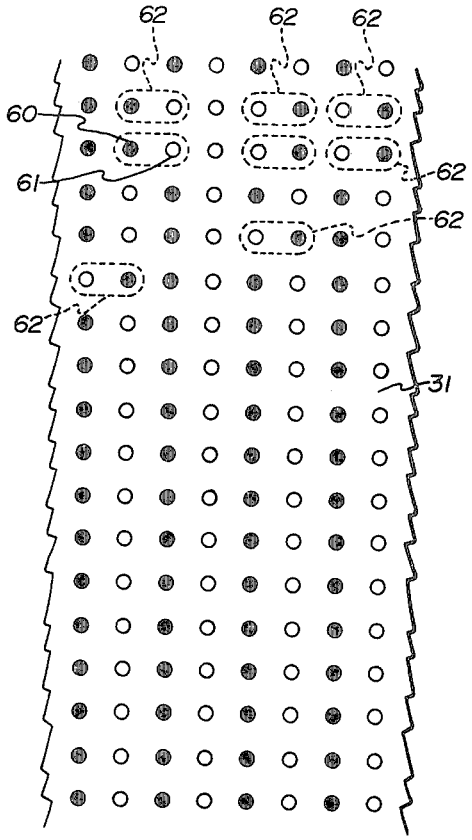

FIGS. 3A and 3B illustrate the effect of the above-described laser anneal step on an atomic scale. In those Figures, a plurality of circles 60 and 61 represent the rare-earth elements within the crystalline magnetic film 31. More specifically, reference numeral 60 schematically indicates one of the rare-earth elements (such as Sm, Eu, Er, Tb, La, or Gd) at its crystalline lattice positions; while reference numeral 61 schematically indicates the other rare-earth element (such as Lu, Tm, or Yb) at its lattice positions.

Prior to the laser annealing step, the rare-earth elements are symmetrically disposed at the crystal lattice sites. This is illustrated in FIG. 3A. Note that in actuality, the ordering of elements 60 and 61 need only be as little as 1% or 2% to give rise to a magnetic moment throughout the film perpendicular to its surface; and in FIG. 3A this ordering is exaggerated to more clearly illustrate the inventive phenomenon that is taking place.

During the laser anneal step of FIG. 2, some of the rare-earth elements in surface region 33 gain sufficient energy to move to new lattice sites. Consequently, after the anneal, the rare-earth elements are less symmetrically disposed in region 33 than in the film's bulk. This is illustrated in FIG. 3B. There, reference numeral 62 indicates various pairs of rare-earth elements which interchange lattice positions due to the laser annealing.

Figure 1:
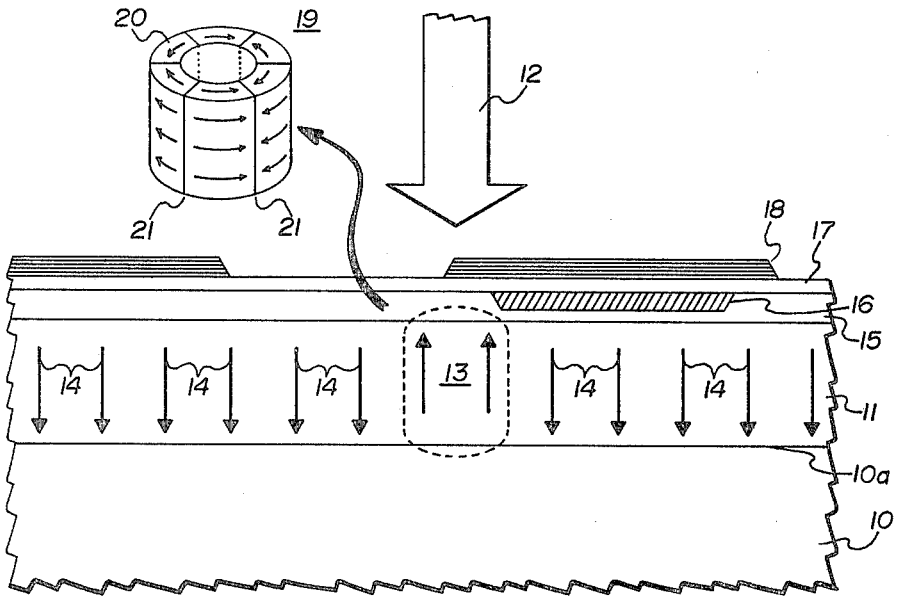
Fig. 1 (PRIOR ART)
FIG. 1 is a greatly enlarged cross-sectional view of a prior art bubble memory device which may be improved by the present invention.

Following the above-described laser anneal step, those remaining structures that lie on top of film 31 are constructed in a conventional fashion. In one embodiment, those structures include insulating layer 15, current carrying conductor 16, insulating layer 17, and bubble propagate elements 18 as were previously described in conjunction with FIG. 1.

Alternatively in another embodiment, a patterned masking layer which is made of material that will reflect or totally absorb the laser beam, is disposed on film 31 prior to the anneal step. Suitably, this masking layer is comprised of chromium. Thereafter, with the masking layer in place, the laser anneal step is performed. Thus, the resulting in-plane magnetization layer 41 is patterned to coincide with the openings in the mask. Following this anneal, the masking layer is removed by conventional etchants; and any remaining overlying structures are then fabricated.

Preferably, this patterned in-plane magnetization layer is shaped to form propagation paths for the bubbles. For example, it may be shaped as a plurality of contiguous disks, or a plurality of contiguous annular regions. These propagation paths eliminate the need for forming the bubble propagating elements 18 of FIG. 1.

Figure 4:
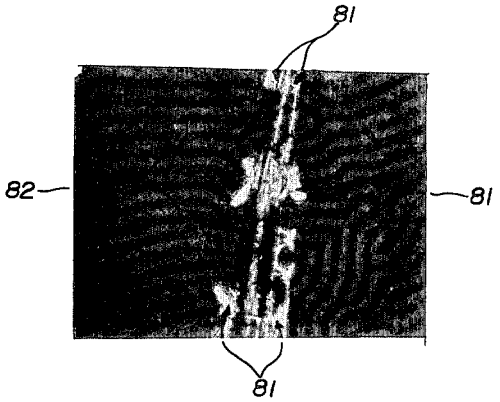
FIG. 4 is a microphotograph of an actual magnetic film that evidences the present inventive concepts.

Reference should now be made to FIG. 4, which is a photograph of an actual magnetic film that has been laser scanned, and which accidently led to the discovery of the present invention. This laser had a wavelength of 4570 A°. But its power level, beam diameter, and scan velocity were not adjusted to raise the temperature of the surface region above 1200° C. and thus cause diffusion of the rare-earth elements among the crystalline lattice sites.

However, during the scanning process, the laser'-scanning mechanism got fouled up. And instead of moving the beam at a uniform speed, it moved the beam erratically. As a result, some regions 81 of the film absorbed so much energy that they melted, and then resolidified as the beam passed by. This completely destroyed the magnetic properties in those regions, as evidenced by the absence of stripes in the regions 81.

But in other regions 82, a melt line can be seen at the regions' perimeter; WHILE STRIPES CAN ALSO BE SEEN INSIDE OF THOSE REGIONS! This indicates that only the surface of those regions 82 received sufficient energy to melt, and that the growth induced anisotropy in the bulk portion of those regions still remained. Otherwise there would be no stripes within the melt line.

Various preferred embodiments of the invention have now been described in detail. In addition however, many changes may be made to these details without departing from the nature and spirit of the invention. Thus, it is to be understood that the invention is not limited to said details, but is defined by the appended claims.

What is claimed is:

1. A crystalline magnetic film which resists hard bubbles from forming in it; said film having oppositely facing top and bottom surfaces with said bottom surface being disposed on a substrate; said film containing at least two rare-earth elements symmetrically disposed at lattice sites in the film's interior and bottom surface to there produce a magnetic moment perpendicular to the film's surfaces; wherein the chemical composition at said film's interior and said film's surfaces is the same, and said rare-earth elements are less symmetrically disposed at the lattice sites in a region at said film's top surface than at said film's interior and bottom surface, to there produce a magnetic moment parallel to said top surface.

2. A crystalline magnetic film according to claim 1 wherein said film is comprised of a non-magnetostrictive material.

3. A crystalline magnetic film according to claim 1 wherein said film is comprised of a positive-magnetostrictive material.

4. A crystalline magnetic film according to claim 1 wherein one of said rare-earth elements is selected from the group consisting of Sm, Eu, Tb, La, Gd, and Y; and another one of said rare-earth elements is selected from the group consisting of Lm, Tm, and Yb.

5. A crystalline magnetic film according to claim 1 wherein said region in which said rare-earth elements are less symmetrically disposed extends from said surface to less than 0.60 micrometers below said surface.

6. A crystalline magnetic film according to claim 1 wherein said region in which said rare-earth elements are less symmetrically disposed is patterned to define bubble propagation paths.

7. A crystalline magnetic film according to claim 1 wherein said region in which said rare-earth elements are less symmetrically disposed extends throughout substantially all of said film's surface and wherein bubble propagating means overlie that region.

8. A method of fabricating a magnetic film which resists hard bubbles from forming in it; said method including the steps of:

providing a crystalline film having oppositely facing top and bottom surfaces with said bottom surface being disposed on a substrate, said film being made of magnetic material having a uniform chemical composition including at least two rare-earth elements symmetrically disposed throughout the film's crystalline lattice which produces a magnetic moment throughout the film perpendicular to said surfaces; and supplying energy to a region at said film's top surface to there produce a magnetic moment parallel to said top surface by redistributing said rare-earth elements among the lattice sites in said region and thus reduce the symmetry with which the rare-earth elements are there disposed without changing said chemical composition.

9. A method according to claim 8 wherein said supplying energy step is performed by a laser anneal.

10. A method according to claim 9 wherein said laser anneal is performed with a laser beam of predetermined wavelength to confine the energy absorbed from the beam to said surface region.

11. A method according to claim 9 wherein said laser anneal heats said region to over 1200° C.

12. A method according to claim 9 wherein said laser anneal is performed with a scanning laser beam which is moved such that no point in said region is continuously exposed to said beam for more than 50 milliseconds.

13. A method according to claim 9 wherein prior to said laser anneal step, a mask is formed over said region and thereafter said laser anneal step is performed with said mask in place.

* * * * *